United States Patent [19]

Cassard

[11] Patent Number: 4,805,325

[45] Date of Patent: Feb. 21, 1989

[54] CLIP-FRAME TYPE DEVICE FOR DISPLAYING A DOCUMENT

[75] Inventor: Denis J. Cassard, Saint-Cloud, France

[73] Assignee: S.A.R.L. Etablissements Rigaux, Villeneuve Le Roi, France

[21] Appl. No.: 139,147

[22] Filed: Dec. 23, 1987

Related U.S. Application Data

[63] Continuation of Ser. No. 873,703, Jun. 12, 1986, abandoned.

[30] Foreign Application Priority Data

Jun. 13, 1985 [FR] France ..... 85 08972

[51] Int. Cl.[4] ..... A47G 1/06; G09F 1/12

[52] U.S. Cl. ..... 40/152; 40/152.1; 40/156; 40/158.1

[58] Field of Search ..... 40/152.1, 152, 156, 40/158 R

[56] References Cited

U.S. PATENT DOCUMENTS

| | | | |
|---|---|---|---|
| 2,625,080 | 1/1953 | Ferlise | 40/156 X |
| 3,541,714 | 11/1970 | Bruck, Jr. | 40/156 |
| 3,798,815 | 3/1974 | Ward | 40/156 |
| 3,924,307 | 12/1975 | Tate | 40/156 |
| 3,958,352 | 5/1976 | Eubank, Jr. | 40/152.1 |
| 3,981,091 | 9/1976 | Wiener, Jr. | 40/156 |
| 4,217,710 | 8/1980 | Becker | 40/156 |
| 4,282,668 | 8/1981 | Jolkovski | 40/152.1 |
| 4,458,873 | 7/1984 | Sutherland | 40/152.1 |
| 4,509,278 | 4/1985 | Astolfi | 40/156 |

FOREIGN PATENT DOCUMENTS

| | | | |
|---|---|---|---|
| 2839974 | 3/1980 | Fed. Rep. of Germany | 40/156 |
| 1536121 | 12/1978 | United Kingdom | 40/156 |

*Primary Examiner*—Robert Peshock
*Assistant Examiner*—J. Hakomaki
*Attorney, Agent, or Firm*—Holman & Stern

[57] ABSTRACT

The device is of the clip-frame type designed to display a document in the form of a text or picture. It comprises spring clips designed to hold the edge of the document against a rigid plane support by means of claws. Each clip is rivetted to the support and the claw on each clip is at the end of a curved branch incorporating a lever. The curvature and elasticity of this branch tend to hold the claw against the document or an optional piece of glass over it. When the lever is depressed the clip "opens" and the claw moves back to enable a document to be inserted or removed.

5 Claims, 1 Drawing Sheet

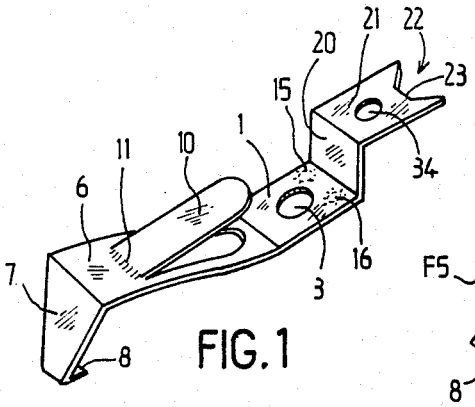
FIG. 1
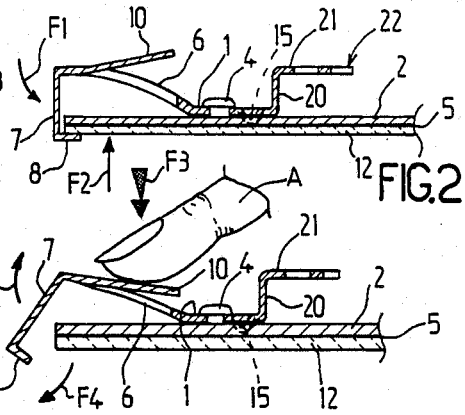
FIG. 2
FIG. 3
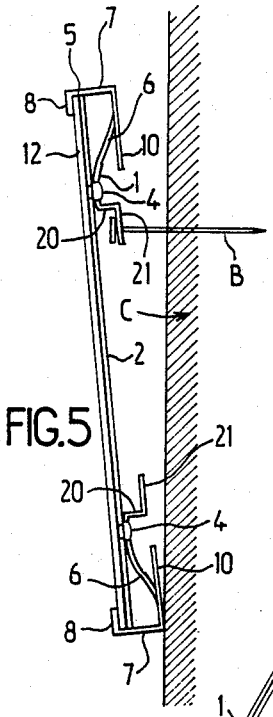
FIG. 5
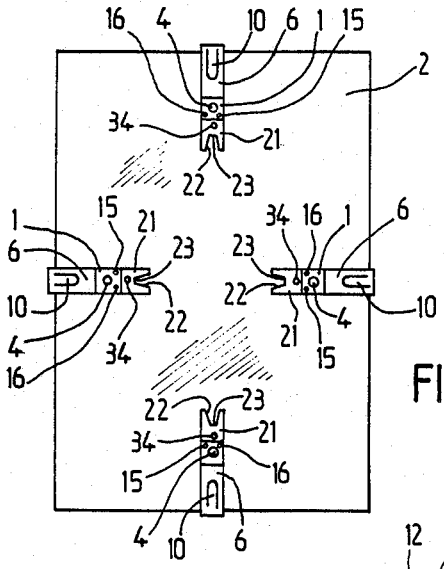
FIG. 4
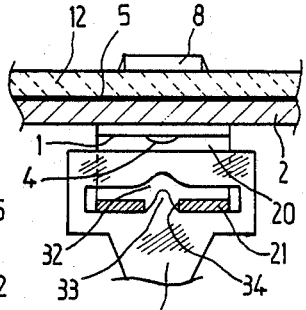
FIG. 8
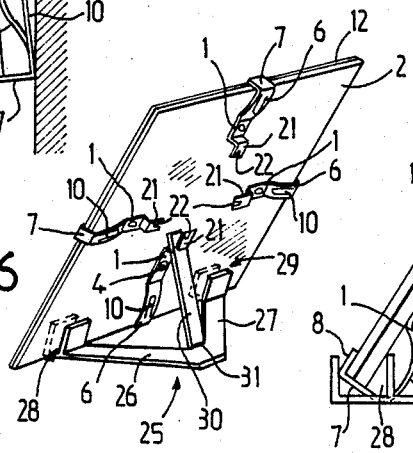
FIG. 6
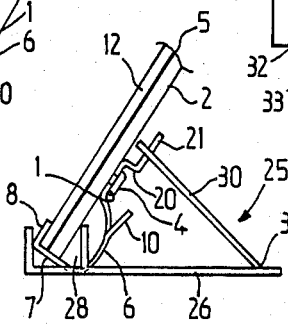
FIG. 7

CLIP-FRAME TYPE DEVICE FOR DISPLAYING A DOCUMENT

This is a continuation of application Ser. No. 73,703, filed June 12, 1986, abandoned.

BACKGROUND OF THE INVENTION

1. Field of the Invention

The invention concerns a clip-frame type device for displaying a document in the form of a text, picture or the like.

2. Description of the Prior Art

There are already known devices called clip-frames which are used to hold a document applied by its edge against a generally rigid support by means of clips disposed on the back surface of the support, generally with a transparent plate such as a piece of glass disposed between the document and the clips.

The spring effect of the clips is usually employed to hold together the support, the document and the glass, as a consequence of which the clips are not positively fastened to the support and so cannot be used to suspend the clip-frame from a hook.

It is then usual to provide additional means such as a string disposed on the back surface of the support and which links together the clips to prevent them moving apart, this string being used to suspend the clip-frame from a nail in the wall.

It has also been proposed to complement the spring clamping effect in order to improve the immobilisation of the clips, in particular by providing sharp tangs designed to penetrate the material of the support, usually wood, particle board, cardboard, etc.

These known devices are not entirely satisfactory since the clips are not effectively secured and assembly is unreliable and often inconvenient.

An object of the present invention is to remedy these disadvantages and to provide a clip-frame type device which is extremely easy to use, the clips of which are positively secured in place, which is easy to assemble and which procures totally effective attachment of the document and the optional glass to the support

SUMMARY OF THE INVENTION

The invention consists in a device for displaying a document in the form of a text, picture or the like, comprising a plane support against a front surface of which the edge of said document is to be pressed, an optional transparent plate adapted to be disposed over said document on said support, and a plurality of spring clips adapted to be applied to a back surface of said support and having at least one claw adapted to overlay said front surface of said support so as to retain said document or said transparent plate, each clip being attached to said support and having an elastic branch providing said claw which is curved in such a way as to apply two forces to said claw, one force in the direction from the edge of said support towards its center and the other force in the direction from said front surface to said back surface of said support, said elastic branch incorporating an offset lever adapted to reverse both said forces simultaneously when said lever is depressed to eliminate its offset.

According to other features of the invention:

each clip comprises at an end opposite said elastic branch a lug bent so as to be spaced from said back surface of said support and incorporating means for fastening said clip to a hook, stand, string or like support device;

said end opposite said elastic branch incorporates a notch;

the device further comprises a stand having at least one housing adapted to accommodate the lower edge of said support and said optional transparent plate and a branch with an opening in its end adapted to accommodate said lug of one of said clips;

said lug is formed with a hole and said opening in said branch adapted to accommodate said lug is formed with a relief member adapted to engage in said hole when said support is fitted into said stand.

Other objects and advantages will appear from the following description of an example of the invention when considered in connection with the accompanying drawing and the novel features will be particularly pointed out in the appended claims.

BRIEF DESCRIPTION OF THE DRAWINGS

FIG. 1 is a schematic view in perspective of a clip in accordance with the invention.

FIGS. 2 and 3 are schematic views illustrating the engaged and disengaged positions of a clip in accordance with the invention in a complete clip-frame device.

FIG. 4 is a rear view of a device in accordance with the invention fitted with four clips.

FIG. 5 is a schematic side view showing a device in accordance with the invention hooked onto a nail driven into a wall.

FIGS. 6 and 7 are schematic views respectively in perspective and in profile of a device in accordance with the invention incorporating a supporting stand.

FIG. 8 is a partial schematic view showing how the stand interlocks with a clip.

DESCRIPTION OF THE PREFERRED EMBODIMENT

Referring to the drawing, a device in accordance with the invention comprises clips that have to be fixed to a plane and relatively rigid support to hold against it a picture, a document, a poster, etc.

Each clip comprises a base 1 for fixing it to a support 2 such as a rigid board of any known type such as particle board, plywood, cardboard, a man-made material or any other material.

In this instance the clips are attached through their base 1 by providing in it a hole 3 through which passes a rivet 4 that passes through all of the thickness of the support 2 but which must not project beyond the front surface of the support 2 to prevent the document 5 to be held from being deformed.

The base 1 of each clip is joined to a branch 6 that is bent to form a lug 7 carrying a small claw 8 substantially parallel to the branch 6.

The branch 6 is curved so as to lie obliquely to the base 1 at an angle in the order of 20 to 25 degrees, so that the claw 8 is substantially level with the base 1.

Part of the branch 6 is cut out to form a lever 10 which is curved in the direction opposite to the branch relative to a transverse line 11.

To make up a complete device a number of clips suited to the size of the support 2 are fitted to the support in an arrangement which varies according to whether it is preferable to have a single clip on each side or a number of clips on two opposite sides and none on the others, and so on.

This fixing may be done on an industrial basis in a particularly efficient manner since the support 2 is of a robust material and it is a simple matter to use tooling for automatically placing the clips according to the size of the support 2 and attaching them by fitting a rivet 4 into each hole 3 in each base 1.

The clips are positioned so that the lug 7 is very close to the edges of the support 2, leaving a slight clearance, the important thing being for the claw 8 to be facing the front surface on which the document 5 to be displayed is placed.

The clip is made of an elastic material, specifically of metal so that after it is fixed on and given the curvature of the branch 6 each clip is in the situation shown in FIG. 2, which shows the clip not only fixed to the support 2 but also in the position retaining a document 5 over which has been placed a transparent plate 12 such as a piece of glass.

FIG. 2 shows that because of the elasticity of the clip and because of the curvature of the branch 6 the latter exerts a force in the direction of the arrow F1, that is to say from the edge of the combination of the support 2/document 5/glass 12 towards the center, together with a force in the direction of the arrow F2 directed from the glass 12 towards the support 2 so that the glass 12 and the document 5 are held against the rigid support 2 and at the same time centered so that they cannot slide laterally parallel to the plane of the support 2.

In the stable position that might be referred to as the active position the assembly is thus totally secured and the fixing of the clips by the rivets 4 makes the assembly extremely reliable since no slipping and no displacement of the clips are possible.

When it is required to demount the assembly, in particular to change the document 5, the lever 10 is depressed in the direction of the arrow F3, for example by pushing it down with a finger A, as shown in FIG. 3.

The lever 10, which was previously offset relative to the branch 6, bends when depressed by the finger A which tends to eliminate the offset between the lever 10 and the branch 6 and the consequence of these coordinated movements is to reverse simultaneously the force in the direction of the arrow F1 and the force in the direction of the arrow F2, so that the clip is deformed elastically on the one hand in the direction of the arrow F4, which corresponds to releasing the claw 8, and on the other hand in the direction of the arrow F5, which corresponds to straightening of the branch 6.

If the pressure of the finger A in the direction of the arrow F3 is only moderate or is released quickly the branch 6 is raised and there is an intimate combination of the two movements in the directions of the arrows F4 and F5, which have been shown separately in order to better explain their nature.

If, on the other hand, the pressure in the direction of the arrow F3 is maintained it is possible to prevent the branch 6 lifting off without preventing it straightening.

It will be understood that to fit the document 5 and the glass 12 it is first necessary to disengage the clip 8 as shown in FIG. 3 and then to release the lever 10 so that the clip returns to its natural position as shown in FIG. 2.

By depressing the lever 10 to a greater or lesser extent the claw 8 is moved in front of the support 2 to a greater or lesser extent, providing for document 5/glass 12 combinations of varying thickness, the clamping action always being effective since the elasticity and curvature of the branch 6 tend always to urge the claw 8 towards the level of the front surface of the support 2.

To make the fixing of the clip to the support 2 even more secure two stamped areas 15 and 16 are provided on the base 1 to penetrate the support 2, this penetration of the stamped portions 15 and 16 into the mass of the support 2 preventing rotation where the rivet 4 might otherwise allow the clip to turn about its axis. On the other side of the hole 3 (or the rivet 4) from the branch 6 is a lug 20 upstanding perpendicularly from the base 1 and joined to a lug 21 bent down parallel to the plane of the base 1 and therefore to the plane of the support 2.

The lug 21 incorporates a notch 22 the base 23 of which is straight and consequently of finite length.

By means of this notch 22 it is possible to hook the clip-frame onto a nail B driven into a wall C (FIG. 5) and the linear part 23 makes it possible to level the device by shifting it from side to side on the nail B.

Note that this facility is of particular benefit since the clip being solidly attached to the support 2 hooking the device onto the nail B does not entail any risk of falling off since even if the device is exposed to vibration the clip cannot come away from the support 2.

The clips in accordance with the invention may also be used not to hook the clip-frame onto a nail but rather to support it on a stand as shown in FIGS. 6 and 7.

The stand 25 comprises two branches 26 and 27 at the ends of which are housings 28 and 29 the width of which is sufficient to accommodate the lower edge of the support 2/document 5/glass 12 combination at an appropriate inclination.

Between the branches 26 and 27 is an upstanding arm 30 which may advantageously be pivoted at its edge 31 so that its position is adjustable.

In a simple arrangement which is not shown the upstanding arm 30 simply rests against the bottom clip of the device, but a more sophisticated version provides for a form of cooperation as shown in FIG. 8.

In this embodiment the upstanding arm 30 incorporates a slot 32 in the middle of which is a relief member 33, the gap between the end of the relief member 33 and the opposite side of the slot 32 being wide enough for the lug 21 to be inserted into it.

The lug is formed with a hole 34 into which the relief member 33 has to penetrate, as shown in FIG. 8.

With an arrangement like this the clip-frame is sure to be perfectly secured to and balanced on the stand 25 since the upstanding arm 30 cannot slip laterally since it is held by the shorter sides of the slot 32 or vertically since it is retained by the relief member 33 inserted into the hole 34.

It is also possible to provide at the end of the upstanding arm 30 a simple notch into which the lug 21 would be inserted, but this simplified arrangement would provide for only lateral retention and not vertical retention of the upstanding arm 30.

The invention makes it possible to produce in the workshop assemblies comprising a support 2 and a number of clips so that the article as sold to the customer is totally produced by industrial means but imposes a pre-defined format.

The invention also encompasses the clips only, as the user can fix these to a support of his choice, using various types of fixing means of greater or lesser reliability.

It is naturally possible to use the invention to display documents with or without the optional transparent plate.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Device for mounting planar element such as a document in the form of a text, picture or the like, comprising a plane support having a front surface on which said document is to be mounted and a plurality of spring clips on a back surface of the support, each clip having at least one claw for engaging over a respective edge of the support and overlaying said front surface of the support to retain the planar element thereon, each clip having a base fixedly attached to the support and an elastic branch extending from the base and terminating in said claw, the branch being curved for applying two elastic forces to the claw, one of said forces being in a direction from the respective edge of the support towards the center of the support and the other of said forces being in a direction from said front surface of the support to said back surface of the support, each clip further including an offset lever extending outwardly from the branch towards the base and generally parallel to the support for reversing both said force simultaneously when the lever is depressed to eliminate the offset thereby dis-engaging the claw from over the respective edge of the support.

2. Device according to claim 1, wherein each clip comprises at an end opposite said elastic branch a lug bent so as to be spaced from said back surface of said support and incorporating means for fastening said clip to a hook, stand, string or like support device.

3. Device according to claim 2, wherein said end opposite said elastic branch incorporates a notch.

4. Device according to claim 2, further comprising a stand having at least one housing adapted to accommodate the lower edge of said support and said optional transparent plate and a branch with an opening in its end adapted to accommodate said lug of one of said clips.

5. Device according to claim 4, wherein said lug is formed with a hole and said opening in said branch adapted to accommodate said lug is formed with a relief member adapted to engage in said hole when said support is fitted into said stand.

* * * * *